US005188029A

United States Patent [19]

Sugimoto et al.

[11] Patent Number: 5,188,029

[45] Date of Patent: Feb. 23, 1993

[54] LABEL PRINTER

[75] Inventors: Kazuaki Sugimoto, Numazu; Satoshi Kitahara; Akio Yamamoto, both of Mishima; Ikuzo Sugiura, Sagamihara, all of Japan

[73] Assignee: Tokyo Electric Co., Ltd., Tokyo, Japan

[21] Appl. No.: 675,981

[22] Filed: Mar. 26, 1991

[30] Foreign Application Priority Data

Mar. 30, 1990 [JP] Japan ..... 2-83949

[51] Int. Cl.[5] ..... B41F 1/08

[52] U.S. Cl. ..... 101/288; 400/692

[58] Field of Search ..... 101/92, 288; 400/692, 400/693, 583, 613.1, 616, 616.1, 616.2; 156/577, 584, 384, DIG. 49

[56] References Cited

U.S. PATENT DOCUMENTS

| | | | |
|---|---|---|---|
| 4,164,182 | 8/1979 | Sato | 101/288 |
| 4,571,103 | 2/1986 | Takeo et al. | 400/616.2 |
| 4,769,103 | 9/1988 | Koike et al. | 156/584 |
| 4,830,522 | 5/1989 | Sato et al. | 101/288 |

*Primary Examiner*—Edgar S. Burr

*Assistant Examiner*—Ren Yan

*Attorney, Agent, or Firm*—Frishauf, Holtz, Goodman & Woodward

[57] ABSTRACT

A label printer includes a body frame and a separating device for separating printed lables from a base. The separating device is detachably mounted on first and second mounting shafts attached to the body frame. The separating device includes a supporting shaft, a pair of supporting members mounted on the opposite end portions of the supporting shaft, and a pair of hook members rotatably mounted on the supporting shaft. Each supporting member has a supporting surface and a engaging recess. The first mounting shaft is removably fitted to the engaging recesses so that the supporting members are rotatable about the first mounting shaft between an off position and a holding position wherein each supporting surface contacts the second mounting shaft so that the supporting member is held between the mounting shafts. Each hook member has a hook portion which engages the second mounting portion to lock the supporting member in its hold position. A separating frame is rotatably mounted on the supporting shaft and supports a separating roller.

14 Claims, 7 Drawing Sheets

LABEL PRINTER

BACKGROUND OF THE INVENTION

1. Field of the Invention

The present invention relates to a label printer for printing item names, bar codes, etc. on labels, and more particularly, to a label printer with a separating device for separating printed labels from a base paper.

2. DESCRIPTION OF THE RELATED ART

Some of separating devices used in label printers are handled as optional parts. One such separating device is constructed as a modular unit, and is provided with a pulse motor and a paper feed mechanism driven by means of the motor so that it can operate by itself. In order to separate labels, printed by means of the printer, from a base paper, the separating device is operated so as to feed that portion of the base paper which is cleared of the labels.

The separating device of this type is positioned by being partially inserted into a socket portion in the bottom plate of the body frame of the label printer, and is screwed to the bottom plate. In this manner, the separating device can be mounted on the printer. At the time of maintenance, therefore, the separating device is drawn out forward from the printer after screws are removed first, reversely following the procedure for mounting.

In the conventional label printers, as described above, the screws must be driven or removed in order to attach or detach the separating device, so that the efficiency of operation for the attachment and detachment of the device is low.

SUMMARY OF THE INVENTION

The object of the present invention is to provide a label printer which facilitates the attachment and detachment of a separating device.

In order to achieve the above object, a label printer according to the present invention comprises: a body having a pair of supporting portions facing each other; printing means arranged between the supporting portions, for printing desired information on labels pasted on an elongated base so as to be arranged side by side along the longitudinal direction of the base; first and second mounting shafts extending parallel to each other between the supporting portions so as to adjoin the printing means; and a separating device removably mounted on the first and second mounting shafts, for separating the printed labels from the base. The separating device includes a supporting shaft extending substantially parallel to the first and second mounting shafts; a pair of supporting members mounted on the supporting shaft and spaced from each other, each of the supporting members having a supporting surface and an engaging recess located at predetermined distance from the supporting surface, the first mounting shaft being removably fitted in the engaging recess so that the supporting member is rotatable around the first mounting shaft between a hold position, in which the supporting surface engages the second mounting shaft so that the supporting member is held on the first and second mounting shafts, and an off position, in which the supporting surface is off the second mounting shaft; a hook member having a hook portion and mounted on the supporting shaft to be movable between a locked position, in which the hook portion engages the second mounting shaft to lock the supporting member to the hold position, and a release position, in which the hook portion is disengaged from the second mounting shaft to allow the supporting member to rotate; urging means for urging the hook member to the locked position; mounting member supported on the supporting shaft; and separating means mounted on the mounting member, for pulling the base, having passed the printing means, in the direction to be separated from the printed labels.

According to the label printer constructed in this manner, the separating device is removably mounted on the first and second mounting shafts. In mounting the separating device, the respective engaging recesses of the supporting members of the device are first caused to engage the first mounting shaft, and the whole separating device is then rotated around the first mounting shaft toward the printing means. Since the supporting members are spaced from each other on the supporting shaft, the separating device can be rotated stably without swaying with respect to the first mounting shaft. Thereupon, the respective supporting surfaces of the supporting members are caused to engage the second mounting shaft with gradually increasing strength. At the same time, the hook member abuts against the second mounting shaft and displaced upward while deflecting the urging means. Immediately after the hook portion of the hook member is situated above the second mounting shaft, it is hooked to the second mounting shaft by means of the urging force of the urging means.

Thus, the separating device is restrained from moving back and forth by the longitudinal engagement between the first and second mounting shafts and the pair of supporting members, and is also prevented from moving vertically by the engagement between the engaging recesses and the first mounting shaft and the engagement of the supporting surfaces and the hook portion with the second mounting shaft.

In this manner, the separating device can be mounted on the printer without using screws.

In removing the separating device from the first and second mounting shafts, the hook member is first rotated to the release position against the urging force of the urging means, thereby disengaging the hook portion from the second mounting shaft, and the whole separating device then is pulled downward. Thereupon, the supporting members are disengaged from the first and second mounting shafts, so that the separating device can be removed from the shafts.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 9 show a label printer according to an embodiment of the present invention, in which:

FIG. 1 is a perspective view of the printer,

FIG. 2 is a front view of the printer with its casing off,

FIG. 3 is a side view, partially in section, showing the printer with its casing off, FIG. 4 is a perspective view showing the principal mechanism of the printer, FIG. 5 is a perspective view showing a separating device, FIG. 6 is an exploded perspective view of the separating device, FIG. 7 is a sectional view showing a process for mounting the separating device, FIG. 8 is a sectional view of the separating device in an operative state, and FIG. 9 is a sectional view of the separating device in which a separating roller is disengaged from a platen roller.

DETAILED DESCRIPTION OF THE PREFERRED EMBODIMENTS

A label printer according to an embodiment of the present invention will now be described in detail with reference to the accompanying drawings.

Figure 1:
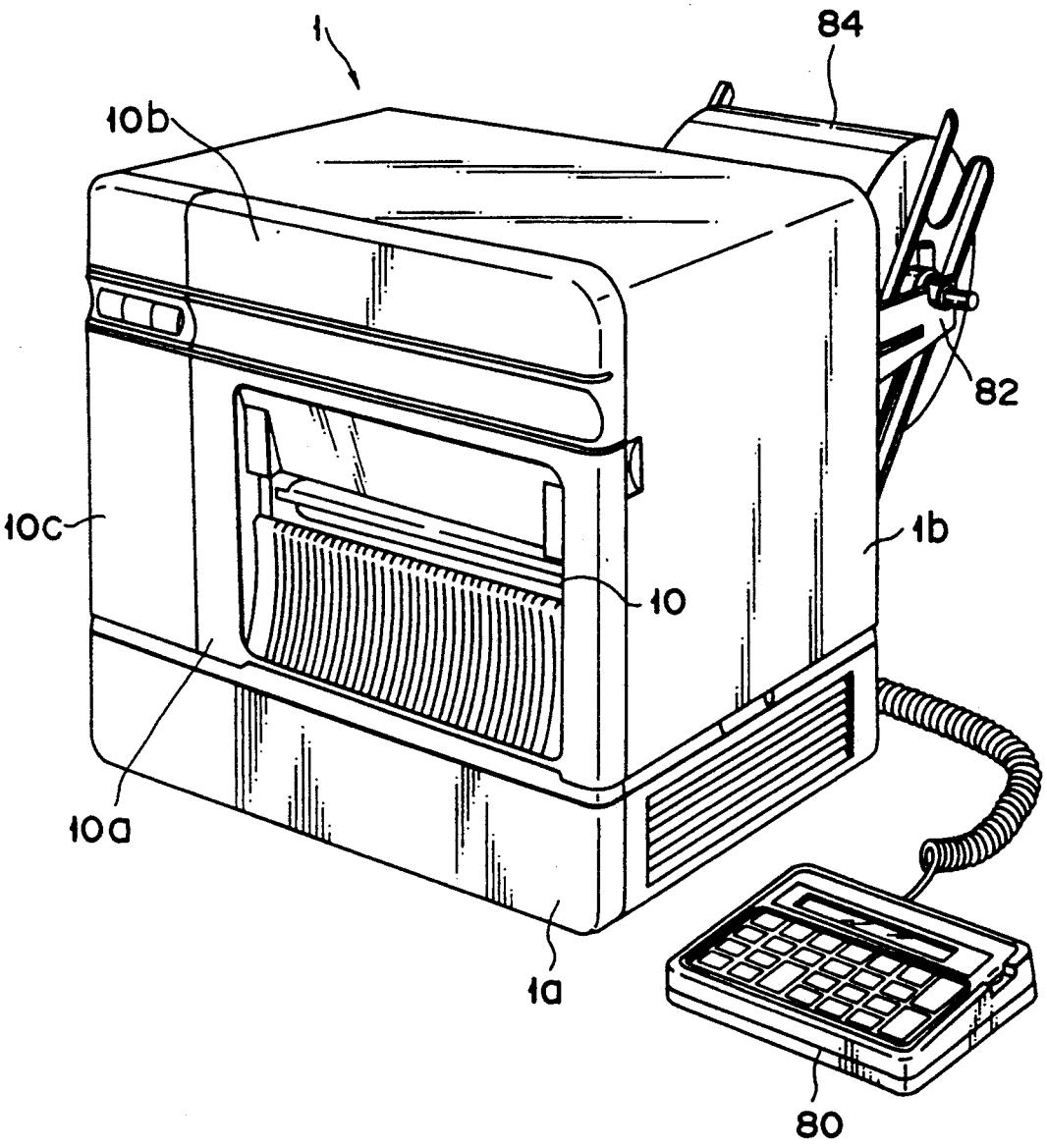
Figure 2:
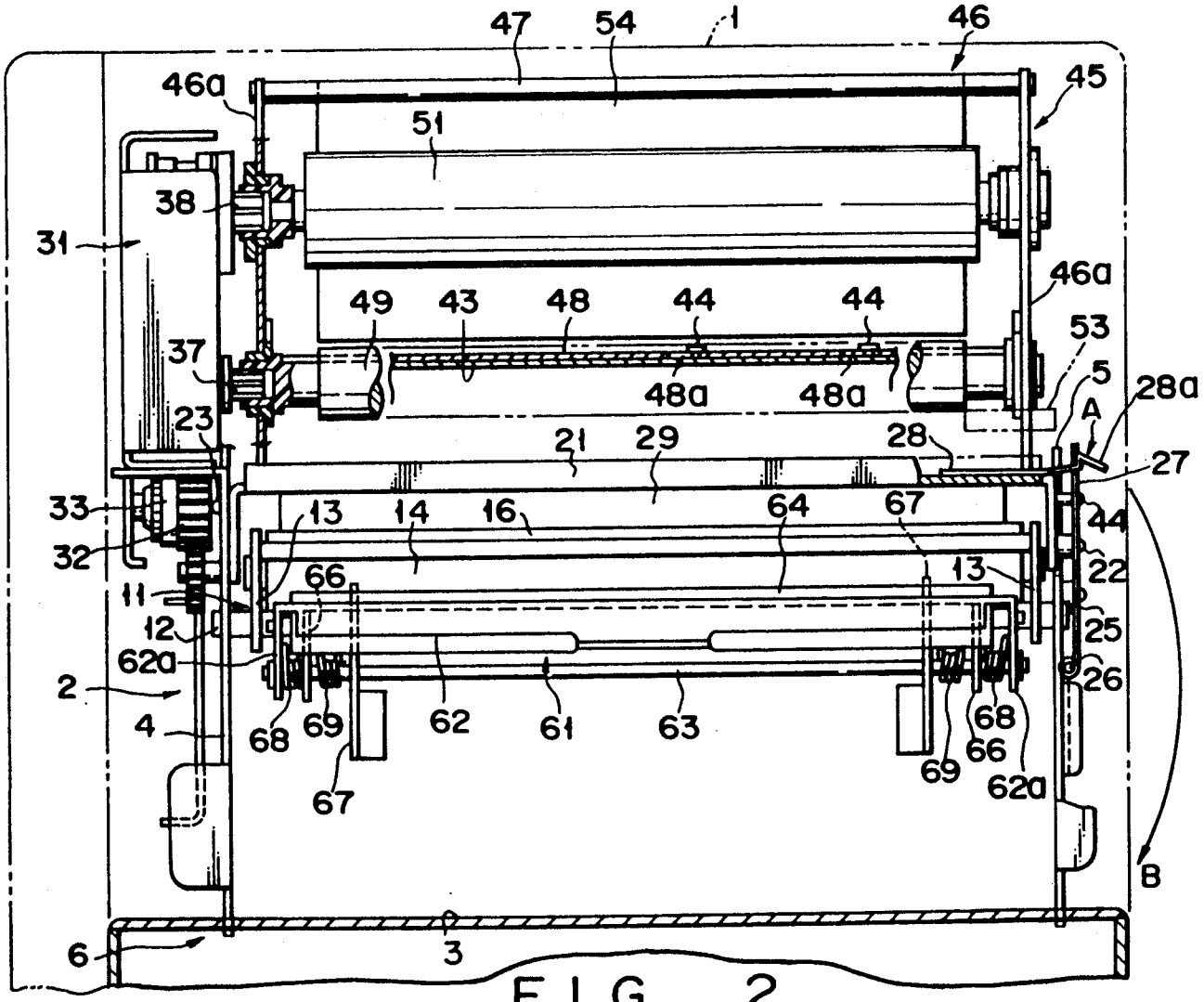
Figure 3:
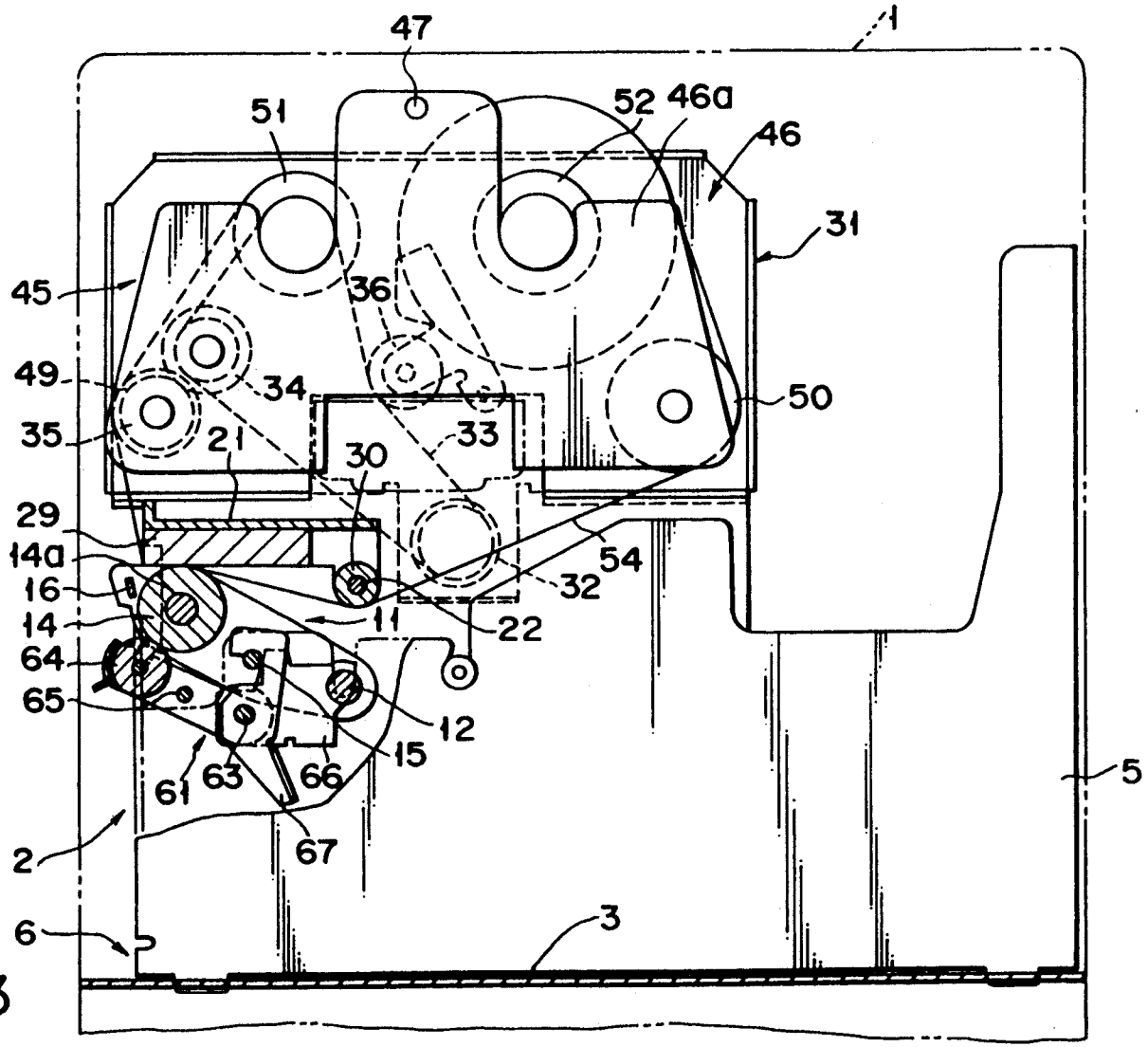

As shown in FIGS. 1 to 3, the label printer has a body casing 1 in the form of a substantially rectangular box. The casing 1 includes a rectangular base 1*a*, a U-shaped side panel 1*b* having a pair of side walls and a top wall, integral with one another, and removably mounted on the base 1*a*, and an L-shaped first front panel 10*a* removably mounted on the base 1*a* and having an outlet port 10 through which printed labels are discharged. The casing 1 further includes a second front panel 10*c* formed integrally with the side panel 1*b* so as to be continuous with the upper portion 10*b* of the first front panel 10*a*, and a third front panel 10*d* fixed to the base 1*a* and situated beside and continuous with the first and second front panels. In FIG. 1, reference numeral 80 denotes a controller for entering print information into the printer.

A printing mechanism 2 is disposed in the body casing 1. The following is a description of the mechanism 2.

As shown in FIGS. 2 and 3, the printing mechanism 2 includes a body frame 6 which constitutes a main body of the printer in association with the casing 1 The frame 6 is formed of a horizontal bottom plate 3, fixed to the upper surface of the base la of the casing 1, and frame side plates 4 and 5 set up on the left and right end portions of the bottom plate, respectively, these plates being connected to one another. The two side plates 4 and 5 stand upright so as to face each other and constitute first and second supporting portions in the present invention.

The printing mechanism 2 further includes a platen unit 11, which is located between the frame side plates 4 and 5 and rockably supported by the same. The unit 11 includes a pivot shaft 12, two end plates 13, a platen roller 14, an intermediate shaft 15, and a torsion spring (not shown).

The pivot shaft 12 is stretched substantially horizontally between the frame side plates 4 and 5. Both end portions of the shafts 12 are nonrotatably fixed to the side plates, respectively. The pivot shaft 12 also serves as a first mounting shaft on which a separating device 61 (described later) will be mounted. The two end plates 13, which face each other, are each in the form of a flat plate, and are arranged adjacent to the side plates 4 and 5, respectively. The respective rear end portions of the end plates 13 are mounted on the support shaft 12 so as to be individually rockable around it.

A bearing (not shown) is mounted on the front end portion of each end plate 13. A platen shaft 14*a* of the platen roller 14 penetrates these bearings to be supported thereby. Thus, the platen roller 14 extend substantially horizontally between the respective front end portions of the two end plates 13. One end portion of the platen roller 14 is connected to a paper feeding mechanism (not shown) so that the roller 14 is driven in association with the feeding mechanism. The intermediate shaft 15 extends between the paired end plates 13 and is located between the pivot shaft 12 and the platen roller 14. The intermediate shaft 15 also serves as a second mounting shaft on which the separating device 61 will be mounted. A separating plate 16 extends between the respective front end portions of the end plates 13 and is situated adjacent to the front portion of the platen roller 14.

The aforesaid torsion spring, which is wound around the pivot shaft 12, has one end portion anchored to a spring bearing (not shown) fixed to the shaft 12, and the other end portion hooked to the intermediate shaft 15 from under the same. The whole structure of the platen unit 11 except the shaft 12 is urged upward by means of the urging force of the torsion spring. Thus, the platen roller 14 is upwardly pressed against a line thermal head 29, which will be described later. If necessary, e.g., at the time of loading or removal of a ribbon unit 46 (mentioned later), moreover, the whole structure of the platen unit 11 except the pivot shaft 12 is rocked downward around the shaft 12 against the urging force of the torsion spring, by manual operation or automatic control.

A head frame 21 is located above the platen unit 11. It is mounted in the manner shown in FIGS. 2 and 4. More specifically, the rear end portion of the frame 21 is fitted on a fixing shaft 22 which protrudes from the side plate 4 toward the side plate 5. A supporting pin 23 protrudes from the front portion of that end of the head frame 21 which faces the side plate 4. The pin 23 is fitted in a through hole (not shown) bored in the plate 4. The extreme end portion of the fixing shaft 22 projects from 2 end wall of the frame 21 on the side of the side plate 5. A supporting pin 24 protrudes from the front end portion of this end wall. The extreme end portion of the shaft 22 and the pin 24 are fitted in holes (not shown), respectively, of a clamp plate 25, which is pivotally mounted on the side plate 5.

Thus, one end side of the head frame 21 is supported on the side plate 4 by means of the fixing shaft 22 and the supporting pin 23, and the other end side is supported on the clamp plate 25 on the side plate 5 by means of the extreme end portion of the shaft 22 and the supporting pin 24. In FIG. 2, numerals 26 and 27 denote a hinge shaft and a retaining hole, respectively, of the clamp plate 25. A leaf spring or retaining plate 28, which is fixed to the upper surface of the head frame 21, is releasably caught by the retaining hole 27. As the plate 28 is hooked to the clamp plate 25 in this manner, the head frame 21 can be kept supported. The frame 21 can be released from the support on the side of the side plate 5 by rocking the clamp plate 25 in the direction of arrow B of FIG. 2 after depressing a distal end portion 28*a* of the retaining plate 28 in the direction of arrow A. In this state, the head frame 21 can be drawn out from the body frame 6 to the right.

The line thermal head 29 is fixed to the lower surface of the head frame 21 and extends parallel to the platen roller 14. The roller 14 is pressed against the head 29 from under the same. As shown in FIG. 3, a guide roller 30 for guiding a transfer ribbon 54 is rotatably mounted on the fixing shaft 22 which supports the head frame 21.

As shown in FIGS. 2 and 3, a ribbon drive unit 31 is mounted on the top end of the side plate 4. The drive unit 31 is operated by means of power from the aforementioned paper feeding mechanism (not shown). The unit 31 includes an input gear 32 connected to the paper feeding mechanism, a transmission belt mechanism 33, a driving gear 34, a driven gear 35, and a tension pulley 36. Rotating shafts 37 and 38 shown in FIG. 2 are rotated by means of the unit 31. These shafts 37 and 38 are provided in pairs.

Figure 4:
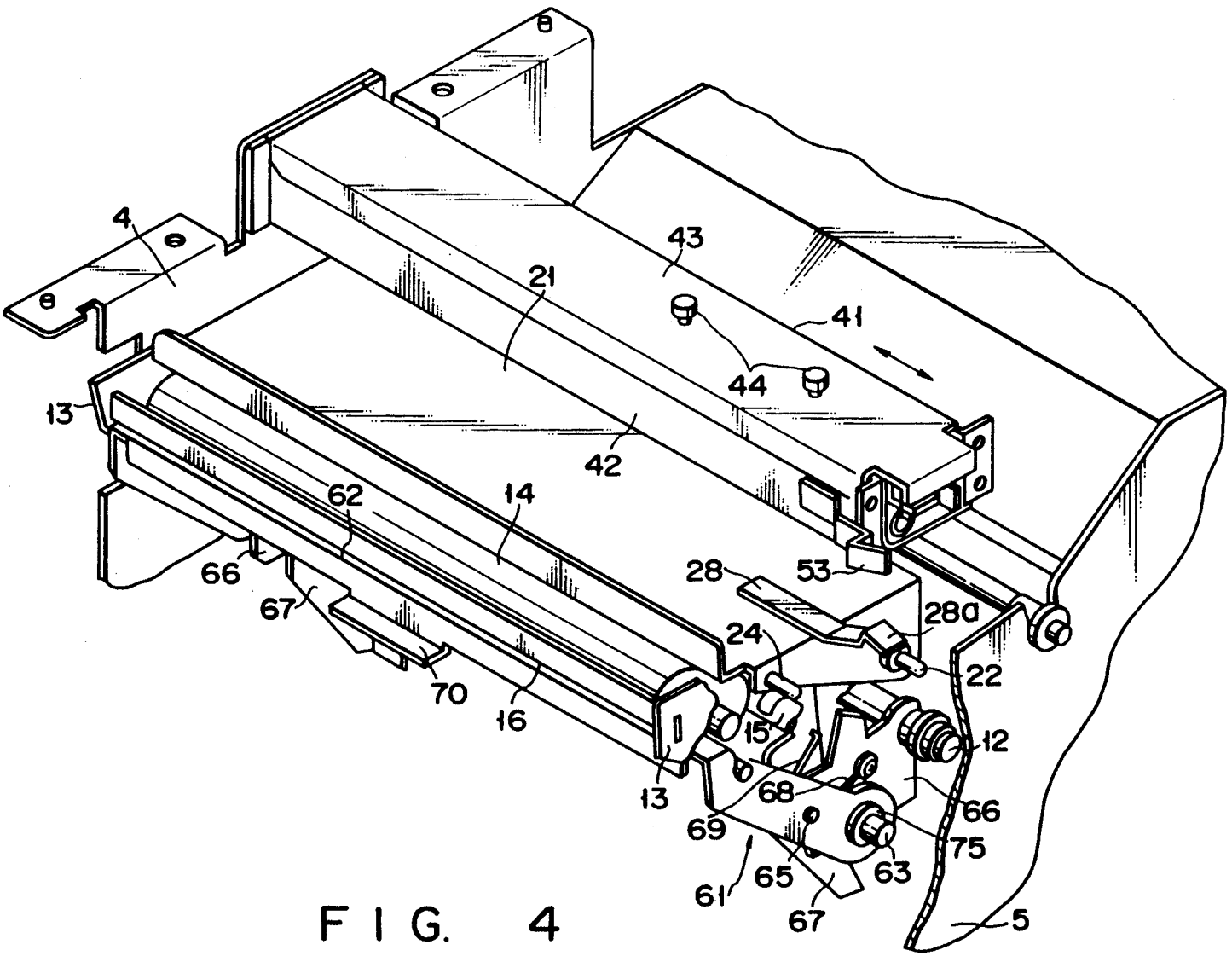

The side plate 4 is fixedly fitted with a ribbon unit mounting section 41 which is situated over the head frame 21. As shown in FIG. 4, the mounting section 41 includes a fixed guide 42, extending parallel to the platen roller 14 and having one end fixed to the side plate 4, and a slider 43 mounted on the guide 42 for movement in the axial direction of the roller 14. A pair of engaging pins 44 protrude from the upper surface of the slider 43.

A ribbon unit 45 is removably mounted on the ribbon unit mounting section 41 in a straddling manner. As shown in FIGS. 2 and 3, the ribbon unit 45 includes a ribbon supporting frame 46, which is formed of a pair of side plates **46*a*, right and left, connected by means of a transverse shaft 47 and a transverse plate 48. A ribbon drive shaft 49 and a ribbon guide shaft 50 transversely extend between the side plates 46*a* for rotation. A ribbon supply shaft 51 and a ribbon take-up shaft 52 transversely extend over the shafts 49 and 50 for rotation The shafts 49 and 50 are immovably fixed to the frame 46, while the shafts 51 and 52 are removably mounted on the frame 46**.

The ribbon unit 45 is mounted on the ribbon mounting section 41 in the following manner. First, the transverse plate 48 of the ribbon supporting frame 46 is placed on the slider 43, and at the same time, the engaging pins 44 of the mounting section 41 are passed individually through the respective large-diameter portions of 8-shaped holes **48*a* in the plate 48. Thereafter, the ribbon unit 45 is slightly moved toward the side plate 4 so that the pins 44 are hooked individually to the respective small-diameter portions of the holes 48*a*. Thereupon, the unit 45 is mounted on the mounting section 41 in a manner such that it is prevented from being disengaged upward. As the ribbon unit 45, along with the slider 43, is moved toward the side plate 4, it is located in a predetermined position in the body frame 6. The unit 45 is kept mounted as a leaf spring or retaining member 53, which is fixed to the fixed guide 42, is hooked to the side plate 46*a* of the ribbon supporting frame 46 on the side of the side plate 5. When the ribbon unit 45 is thus located in position, the respective end portions of the shafts 49 to 52 are fitted individually onto the rotating shafts 37 and 38 of the ribbon drive unit 31** to be connected thereto.

As shown in FIG. 1, a roll 84 of an elongated base paper C is supported on a paper holder 82 which is attached to the rear face of the body casing 1. A large number of labels L (see FIG. 8) are pasted on one side of the paper C at regular intervals in the longitudinal direction of the paper. The base paper C is paid out from the roll 84, transported between the platen roller 14 and the line thermal head 29 to be set in position, and properly fed by the agency of the paper feed mechanism.

The ribbon drive unit 31 is operated in synchronism with the paper feed. A transfer ribbon 54 wound on the ribbon supply shaft 52 is drawn out via the ribbon guide shaft 50 by means of rotatory force transmitted to the ribbon drive shaft 49. At the same time, the used portion of the ribbon 54 which was passed between the platen roller 14 and the thermal head 29 is wound up on the ribbon take-up shaft 51 by means of the rotatory force transmitted thereto. The feed of the transfer ribbon 54 is substantially equal to that of the base paper C, and ink of the ribbon 54 is thermally transferred to the labels L by printing operation of the thermal head 29.

In attaching to or detaching the ribbon unit 45 from the body frame 6, the clamp plate 25 is rocked in the direction of arrow B of FIG. 2 so that the head frame 21 is supported like a cantilever, and the platen unit 11 is then manually lowered to disengage the roller 14 from the line thermal head 29. In this state, the transfer ribbon 54 is inserted or drawn out from between the roller 14 and the head 29 on the side of the side plate 5.

Referring now to FIGS. 2 to 7, the separating device 61 will be described in detail. The device 61, along with the separating plate 16 mounted on the platen unit 11, is used to separate the printed labels L from the base paper C.

The separating device 61 is in the form of a modular unit comprising a separating frame 62, a supporting shaft 63, a separating roller 64, a pressure shaft 65, a pair of supporting plates 66, a pair of hook members 67, a pair of first torsion springs 68, and a pair of second torsion springs 69.

Figure 5:
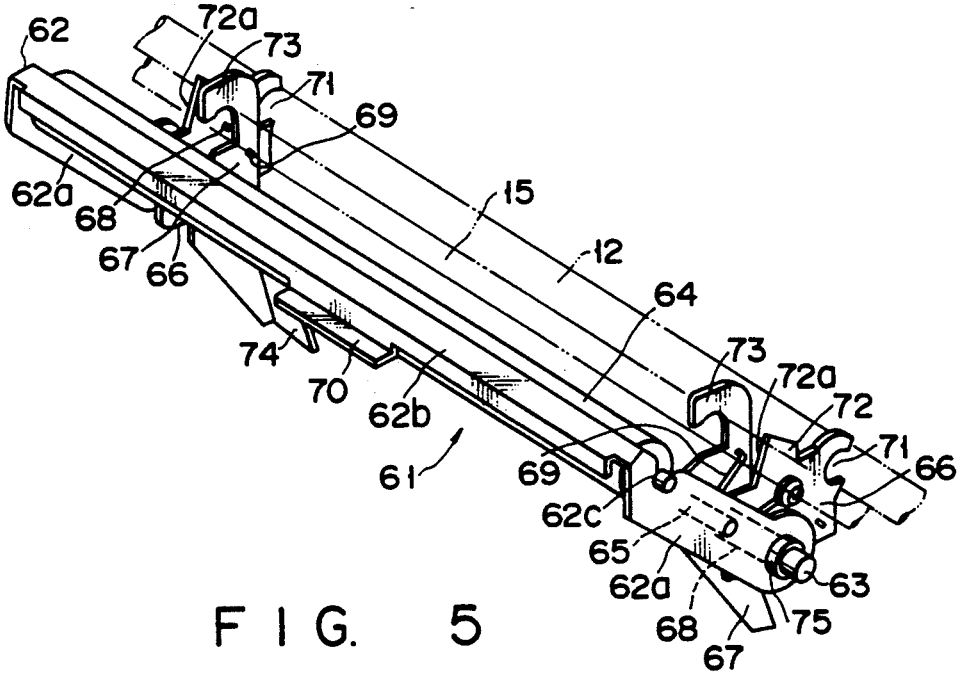
Figure 6:
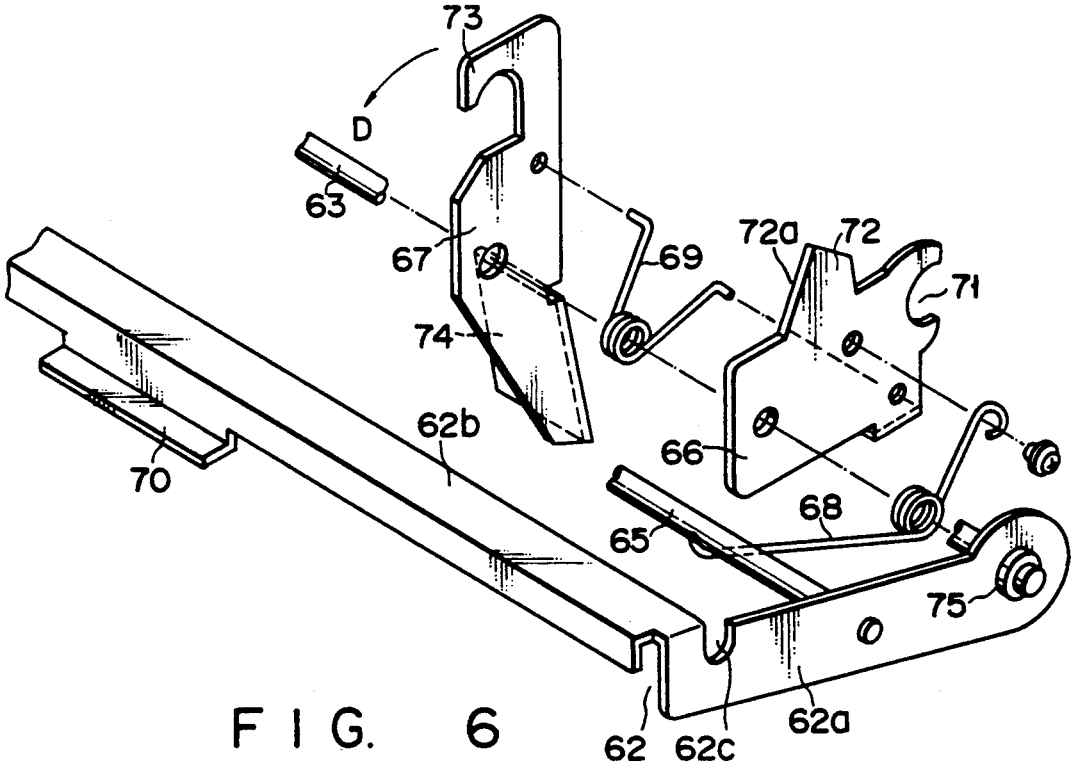

The separating frame 62 as a mounting member of the invention is formed of a pair of arms **62*a* and a transverse plate 62*b* integrally connecting the respective front ends of the arms 62*a*. A tongue or operating portion 70 integrally protrudes forward from the central portion of the transverse plate 62*b* with respect to the longitudinal direction thereof. The supporting shaft 63 underlies the pivot shaft 12 and the intermediate shaft 15 so as to extend parallel thereto. The right and left arms 62*a* are rotatably fitted on the two opposite end portions of the supporting shaft 63, individually. Thus, the separating frame 62 is supported on the supporting shaft 63 so as to be rotatable around the axis thereof, and the transverse plate 62*b* extends parallel to the shaft 63. In FIGS. 4 and 5, numeral 75 denotes a retaining ring for preventing the frame 62 from moving in the axial direction of the shaft 63. The pressure shaft 65 extends transversely between the arms 62*a* so as to be situated between the transverse plate 62*b* and the supporting shaft 63. The separating roller 64, which extends transversely between the respective front portions of the arms 62*a*, is rotatably supported parallel to the platen roller 14. An open-topped supporting recess 62*c* is formed at the front portion of each arm 62*a*, and each corresponding shaft end portion of the separating roller 64 is removably fitted in the recess 62*c***.

The paired supporting plates 66 are fitted individually on the opposite end portions of the supporting shaft 63. Each supporting plate 66 is in the form of a flat plate projecting rearward from the shaft 63. Each plate 66 has a recess 71 at the back and a mounting projection 7 protruding upward from the front portion thereof. The recess 71 has the shape of a semicircle with the same diameter as the pivot shaft 12. Alternatively, it may be formed in a rectangular shape. The front end of the mounting projection 72 constitutes a slanting engaging surface 72*a*, which ascends toward the top end of the projection 72. In other words, the surface 72*a* is inclined so that the distance from the recess 71 increases from the distal end of the projection 72 toward the supporting shaft 63.

Each hook member 67, which is also in the form of a flat plate, is rotatably fitted on each corresponding end portion of the supporting shaft 63. Each member 67 has a hook 73 situated above the shaft 63, and an operating portion 74 below the shaft 63.

Each first torsion spring 68 is wound on the supporting shaft 63 and situated between its corresponding arm 62*a* and supporting plate 66. One end portion of the spring 68 is anchored to the pressure shaft 65 from below, while the other end portion is fixed by a screw to the supporting plate 66. The first torsion springs 68 urge the separating roller 64 upward through the medium of the pressure shaft 65 and the separating frame 62. Thus, the roller 64 is pressed against the underside of the platen roller 14 by means of the urging force of the springs 68.

Each second torsion spring 69 is wound on the supporting shaft 63 and is situated between its corresponding supporting plate 66 and hook member 67. One end portion of the spring 69 is anchored to the plate 66, while the other end portion is hooked to the member 67. Thus, the second torsion springs 69 urge the hook members 67 in the direction of arrow D of FIG. 6, that is, toward a locked position, by means of its elastic force.

The separating device 61, constructed in this manner, is located between the side plates 4 and 5 of the body frame 6, and is removably mounted on the platen unit 11 in the following manner.

Figure 7:
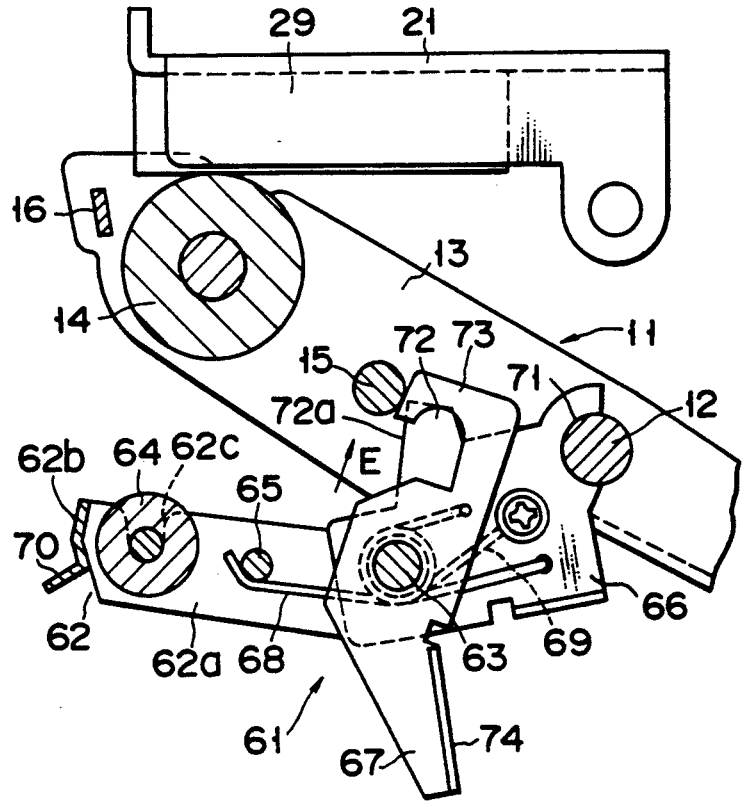

As shown in FIG. 7, the respective recesses 71 of the paired supporting plates 66 are first caused to engage the pivot shaft 12 from the front side. Then, the whole separating device 61 is rotated upward in the direction of arrow E of FIG. 7 around the pivot shaft 12, with the recesses 71 and the pivot shaft 12 kept in engagement with one another. This upward rotation can be stably achieved without causing the separating device 61 to sway with respect to the pivot shaft 12, since the supporting plates 66 at the opposite end portions of the device 61 are in engagement with the pivot shaft 12.

Thereupon, the mounting projection 72 of each supporting plate 66 penetrates between the pivot shaft 12 and the intermediate shaft 15 so that its slanting engaging surface 72*a* engages the circumferential surface of the rear portion of the shaft 15. The force of engagement between the shaft 15 and the surfaces 72*a* is gradually increased as the upward rotation of the supporting plates 66 advances. At the same time, the force of engagement between the recesses 71 and the pivot shaft 12 is also increased by a reaction to the aforesaid engagement. Thus, that portion of each plate 66 which is situated between the recess 71 and the engaging surface 72*a* is held between the pivot shaft 12 and the intermediate shaft 15.

As the supporting plates 66 rotate upward in this manner, the front end edge of the hook 73 of each hook member 67 comes into contact with the circumferential surface of the rear portion of the intermediate shaft 15, as shown in FIG. 7, to be displaced upward while deflecting the second torsion spring 69. Immediately after the hook 73 is situated above the shaft 15, the hook member 67 is rocked in the counterclockwise direction of FIG. 7 around the supporting shaft 63 by the urging force of the spring 69. Thereupon, the hook 73 engages the intermediate shaft 15 from above.

As described above, the separating device 61 is upwardly rotated substantially at a stroke around the pivot shaft 12 after the respective recesses 71 of the supporting plates 66 of the device 61 are pressed against the pivot shaft 12. Thus, the device 61 can be easily mounted on the platen unit 11 of the printing mechanism 2 by utilizing the pivot shaft 12 and the intermediate shaft 15.

Figure 8:
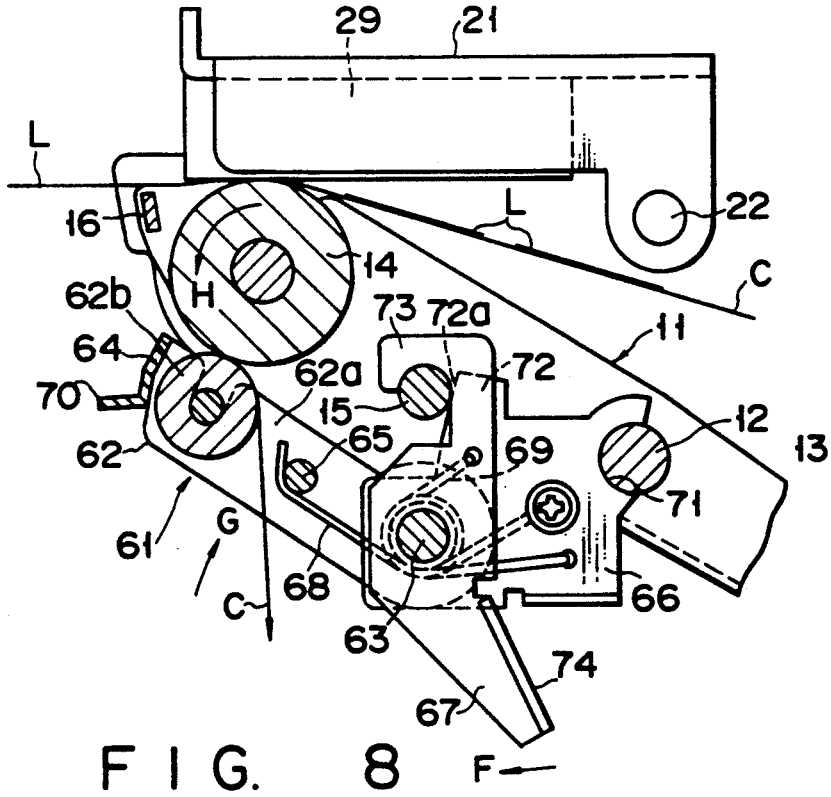

FIG. 8 shows how the separating device 61 is mounted in position. In this state, each supporting plate 66 is restrained from moving back and forth by means of the pivot shaft 12 and the intermediate shaft 15, and is also restrained from moving vertically by the engagement between the recess 71 and the pivot shaft 12 and between the hook member 67 and the shaft 15. The separating roller 64, which faces the platen roller 14 in parallel relation, is pressed against the roller 14 by means of the springs 68.

In removing the separating device 61 from the platen unit 11 for maintenance or some other purpose, the respective operating portions 74 of the hook members 67 are first pressed in the direction of arrow F of FIG. 8 to rotate the members 67 clockwise, thereby disengaging the hooks 73 from the intermediate shaft 15. Then, the whole separating device 61 is rotated downward around the pivot shaft 12. Thereupon, the respective engaging surfaces 72*a* of the mounting projections 72 are disengaged from the shaft 15, and the recesses 71 from the pivot shaft 12. In this manner, the separating device 61 can be removed with ease.

The following is a description of processes for issuing labels with the separating device 61 mounted on the platen unit 11, as shown in FIG. 8.

Figure 9:
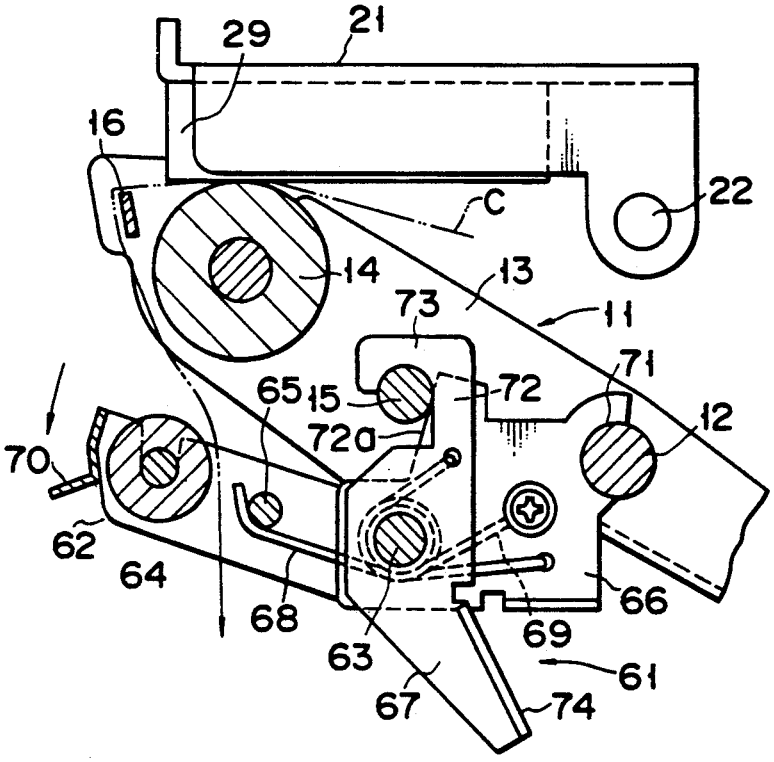

Prior to the label issuing, the base paper C is set in the following manner. First, the paper C is passed between the platen roller 14 and the line thermal head 29, and is guided to the region under the roller 14 via the separating plate 16. Then, the operating portion 70 of the separating frame 62 is depressed by a finger to rotate the frame 62 downward against the urging force of the first torsion springs 68, as shown in FIG. 9. Thereupon, the separating roller 64 leaves the platen roller 14, so that the leading end portion of the base paper C is passed between the rollers 14 and 64, and the paper C is transported past the separating frame 62 along the rear end portion of the roller 64. Thereafter, the separating frame 62 is released from the depression. As a result, the separating roller 64 is pressed against the platen roller 14 across the paper C from under the same, as shown in FIG. 8, by means of the urging force G of the first torsion springs 68.

After this setting work, the aforementioned label issuing operation is performed. Thereupon, the base paper C is fed by means of the drive force from the paper feeding mechanism, so that the labels L are separated correspondingly. More specifically, the platen roller 14 is rotated in the direction of arrow H of FIG. 8 by means of the drive force from the paper feeding mechanism, and the paper C wound on the roller 14 is fed in the same direction. At the same time, the separating roller 64, which is pressed against the platen roller 14 across the paper C, is driven to rotate in synchronism with the roller 14. Thereupon, the paper C is pulled strongly by the separating roller 64, and drastically turns at the location of the separating plate 16 to be fed downward. Thus, the printed labels L, pasted on the base paper C, are separated from the paper C at the location of the plate 16, and are issued one after another.

In interrupting the label issuing operation described above, the operation of the paper feeding mechanism is stopped. Since the separating roller 64, pressed against the platen roller 14, is rotated in a driven manner, as mentioned before, its rotation is stopped when the rotation of the roller 14 is stopped. Therefore, the separating roller 64 alone cannot continue to rotate after the rotation of the platen roller 14 is stopped, so that the base paper C cannot be moved by means of the roller 64. Thus, the paper C is prevented from being deviated from a predetermined stop position, printing can be made in a normal position on each label when a desired number of labels are issued as the next lot. Moreover, the trouble of adjusting the position of the base paper C by trial printing, in order to ensure normal printing, can be saved, so that the operating efficiency can be improved.

In the arrangement of the label printer described above, after the recesses 71 of the supporting plates 66 of the separating device 61 are caused to engage the pivot shaft 12, for use as a first mounting shaft, the whole separating device is rotated upward around the first mounting shaft. By doing this, the respective engaging surfaces 72*a* of the plates 66 are caused to engage the intermediate shaft 15, for use as a second mounting shaft, with gradually increasing strength. At the same time, the hook members 67 abut against the second mounting shaft to be displaced upward while deflecting the second torsion springs 69, and their respective hooks 73 are caused to engage the second mounting shaft by means of the urging force of the springs 69. Thus, the separating device 61 can be easily mounted on the printer by the aforementioned one-stroke operation without requiring screwing. Moreover, the separating device can be readily removed from the printer by operating the respective operating portions 74 of the hook members 67 to rotate the members 67 against the urging force of the springs 69, thereby disengaging the hooks 73 from the second mounting shaft, and then pulling the whole device 61 downward.

Each arm 62*a* of the separating frame 62 is formed having an upwardly open engaging recess 62*c*, and the separating roller 64 is supported on the frame 62 in a manner such that each shaft end portion thereof is removably fitted in the recess 62*c*. If necessary, therefore, the roller 64 can be easily removed from the frame 62 for cleaning or the like.

Further, the separating roller 64 is pressed against the platen roller 14 across the base paper C, and is driven to rotate in synchronism with the roller 14. Therefore, it is unnecessary to provide an exclusive drive source for rotating the separating roller 64, so that the whole separating device 61 can be made compact and light in weight.

It is to be understood that the present invention is not limited to the embodiment described above, and that various changes and modifications ma be effected therein by one skilled in the art without departing from the scope or spirit of the invention.

The separating device 61 may be of any type, provided that it is in the formed of modular unit. For example, the device 61 may be provided with a motor so that it can operate independently by itself.

According to the present invention, moreover, it is necessary only that the hook member 67 be provided at at least one end portion of the supporting shaft 63.

According to the embodiment described above, furthermore, each supporting plate is designed so that the recess 71 and the engaging surface 72*a* engage the peripheral surface of the front portion of the pivot shaft 12 and the peripheral surface of the rear portion of the intermediate shaft 15, respectively. Alternatively, however, the supporting plate may be designed so that the recess 71 and the surface 72*a* engage the peripheral surface of the rear portion of the pivot shaft 12 and the peripheral surface of the front portion of the intermediate shaft 15, respectively. Likewise, each hook member 67 may be formed so that the hook 73 extends in the opposite direction to the one according to the embodiment described above. In this case, the second torsion spring 69 is designed so that its urging force acts in the opposite direction.

In the foregoing embodiment, furthermore, the pivot shaft 12 and the intermediate shaft 15 double as the first and second mounting shafts, respectively. Alternatively, however, these mounting shafts may be provided independently of the pivot shaft 12 and the shaft 15. In this case, the first and second mounting shafts are stretched transversely between the side plates 4 and 5.

What is claimed is:

1. A label printer comprising:

a body having a pair of supporting portions facing each other;

printing means arranged between the supporting portions, for printing desired information on labels which are pasted on an elongated base and arranged side by side along the longitudinal direction of the base;

first and second mounting shafts extending substantially parallel to each other between the supporting portions so as to adjoin the printing means;

a separating device removably mounted on the first and second mounting shafts, for separating printed labels from the base, said separating device including:

a supporting shaft extending substantially parallel to the first and second mounting shafts, a pair of supporting members mounted on the supporting shaft and spaced apart from each other, each of the supporting members having a supporting surface and an engaging recess separated by a predetermined distance from their respective supporting surface, the first mounting shaft being removably fitted in the engaging recesses so that the supporting members are rotatable around the first mounting shaft between a hold position, in which the supporting surfaces engage the second mounting shaft so that the supporting members are held on the first and second mounting shafts, and an off position, in which the supporting surfaces are off the second mounting shaft, a hook member having a hook portion and mounted on the supporting shaft to be movable between a locked position, in which the hook portion engages the second mounting shaft to lock the supporting members in the hold position, and a release position, in which the hook portion is disengaged from the second mounting shaft to allow the supporting members to rock, urging means for urging the hook member to the locked position, a mounting member supported on the supporting shaft, and separating means mounted on the mounting member, for pulling the base, having passed the printing means, in the direction to be separated from the printed labels;

said printing means including a platen roller extending parallel to the first and second mounting shafts between the pair of supporting portions, and a print head for printing the desired information on the labels on the base passed between the print head and the platen roller; and said separating means including a separating roller rotatably supported by the mounting member and extending substantially parallel to the platen roller, the separating roller being in contact with the platen roller on the opposite side thereof to the print head so that the base having passed the print head is held between the platen roller and the separating roller.

2. A printer according to claim 1, wherein the engaging recesses and the supporting surface of each of said supporting members are situated between the first and second mounting shafts.

3. A printer according to claim 2, wherein said engaging recesses have a semicircular shape substantially identical to the cross section of the first mounting shaft.

4. A printer according to claim 2, wherein said supporting surfaces are inclined so that the distance between the first mounting shaft and a first portion of the supporting surfaces which face the second mounting shaft as the supporting members are in the off position is less than the distance between the first mounting shaft and a second portion of the supporting surfaces which face the second mounting shaft as the supporting members are in the hold position.

5. A printer according to claim 1, wherein said urging means includes a torsion spring mounted on the supporting shaft, the torsion spring having a first arm portion fixed to ne of the supporting members and a second arm portion fixed to the hook member.

6. A printer according to claim 1, wherein said hook member includes an operating portion for rotating the hook member, the operating portion being situated on the opposite side of the supporting shaft to the hook portion.

7. A printer according to claim 1, wherein said mounting member is rotatably supported on the supporting shaft, and the separating means includes an urging member urging the mounting member in a direction such that the separating roller comes into contact with the platen roller.

8. A printer according to claim 1, wherein said mounting member is rotatably supported on the supporting shaft and includes a pair of arm portions situated on the opposite sides of the separating roller, each arm portion having a supporting recess opening toward the platen roller, and the separating roller has a pair of shaft end portions removably fitted individually in the supporting recesses.

9. A printer according to claim 1, wherein said printing means includes a pivot shaft supported between the pair of supporting portions and constituting the first mounting shaft, a pair of end plates rockably supported on the pivot shaft, and a connecting shaft connecting the end pates to each other and constituting the second mounting shaft, and the platen roller is rotatably supported on the end plates on the opposite side of the second mounting shaft to the first mounting shaft.

10. A printer according to claim 9, wherein said separating device includes a separating plate mounted between the pair of end plates and facing the platen roller, and the portion of the base which has passed the print head being guided over the separating plate and thereafter being guided between the separating roller and the platen roller.

11. A label printer for printing desired information on labels which are pasted on an elongated base and arranged side by side along the longitudinal direction of the base, the printer comprising:

a body having a pair of supporting portions facing each other;

a printing mechanism having a platen roller extending between the supporting portions, and a print head for printing desired information on the labels on the base passing between the print head and the platen roller;

first and second mounting shafts extending parallel to the platen roller between the supporting portions so as to adjoin the printing mechanism; and a separating device removably mounted on the first and second mounting shafts, for separating printed labels from the base, said separating device comprising:

a supporting shaft extending substantially parallel to the first and second mounting shafts, a pair of supporting members mounted on the supporting shaft and spaced apart from each other, each of the supporting members having a supporting surface and an engaging recess separated by a predetermined distance from their respective supporting surfaces, the first mounting shaft being removably fitted in the engaging recesses so that the supporting members are rotatable around the first mounting shaft between a hold position, in which the supporting surfaces engage the second mounting shaft so that the supporting members are held on the first and second mounting shafts, and an off position, in which the supporting surfaces are off the second mounting shaft, a hook member having a hook portion and mounted on the supporting shaft to be movable between a locked position, in which the hook portion engages the second mounting shaft to lock the supporting members in the hold position, and a release position, in which the hook portion is disengaged from the second mounting shaft to allow the supporting members to rock, urging means for urging the hook member to the locked position, a mounting member supported on the supporting shaft, and a separating roller rotatably supported by the mounting member and extending substantially parallel to the platen roller, the separating roller being in contact with the platen roller on the opposite side thereof to the print head so that the base having passed the print head is held between the platen roller and the separating roller and is pulled in the direction to be separated from the printed labels.

12. A label printer for printing desired information on labels which are pasted on an elongated base and arranged side-by-side in the longitudinal direction of the base, said printer comprising:

a body having a pair of supporting portions facing each other;

a printing mechanism having a platen roller extending between the supporting portions, and a print head for printing desired information on the labels on the base passing between the platen roller and the print head;

mounting portions provided on the supporting portions;

a modular separating device manually removably mounted on the mounting portions, for separating the printed labels from the base, said separating device comprising:

supporting means manually detachably fitted to the mounting portions; and manually actuated locking means for locking the supporting means in a state wherein the supporting means are removably fitted to the mounting portions; and a separating roller rotatably mounted on said supporting means, said separating roller being in rolling contact with the platen roller, for pulling the base which has passed the print head and the separating means and is held between the platen roller and the separating roller, in a direction to be separated from the printed labels.

13. A printer according to claim 12, wherein said supporting means includes a pair of supporting members rotatably fitted to the mounting portions, and the separating roller extends between the supporting members in parallel to the platen roller.

14. A printer according to claim 15, wherein said modular separating device includes urging means for urging the separating roller against the platen roller.

* * * * *

UNITED STATES PATENT AND TRADEMARK OFFICE

CERTIFICATE OF CORRECTION

PATENT NO. : 5,188,029

DATED : February 23, 1993

INVENTOR(S) : Sugimoto et al

It is certified that error appears in the above-identified patent and that said Letters Patent is hereby corrected as shown below:

Title page, Section [56], References Cited:

Under the heading "U.S. PATENT DOCUMENTS" add:
--4,477,305 10/1984 Hamisch, Jr. et al.....156/384--.

Under the heading "FOREIGN PATENT DOCUMENTS" add:
--0,249,142 12/1987 European Patent Office
0,361,693 4/1990 European Patent Office-- .

Signed and Sealed this

Fifteenth Day of March, 1994

*Attest:*

Bruce Lehman

BRUCE LEHMAN

*Attesting Officer*

*Commissioner of Patents and Trademarks*